US005307283A

United States Patent [19]

Sawazaki et al.

[11] Patent Number: 5,307,283

[45] Date of Patent: Apr. 26, 1994

[54] METHOD OF PREPARING PATTERN INFORMATION FOR JACQUARD FABRIC

[75] Inventors: Masatoshi Sawazaki, Hyogo; Takao Shibata, Osaka, both of Japan

[73] Assignee: Precision Fukuhara Works, Ltd., Japan

[21] Appl. No.: 803,139

[22] Filed: Dec. 5, 1991

[51] Int. Cl.[5] ..... G06F 15/46

[52] U.S. Cl. ..... 364/470; 66/218; 66/163

[58] Field of Search ..... 364/470; 66/10, 22, 66/25, 161, 163, 196-202, 218, 219

[56] References Cited

U.S. PATENT DOCUMENTS

| | | | |
|---|---|---|---|
| 3,808,843 | 5/1974 | Blore et al. | 66/196 |
| 3,835,668 | 9/1974 | Schiebel et al. | 66/19 |
| 4,771,614 | 9/1988 | Kemp | 66/202 |
| 4,797,311 | 1/1989 | Kemp | 66/200 |
| 4,838,045 | 6/1989 | Cournoyer et al. | 66/196 |
| 4,841,748 | 6/1989 | Watanabe et al. | 66/218 |
| 4,926,660 | 5/1990 | Takashi | 66/93 |
| 5,109,680 | 5/1992 | Pernick | 66/193 |

*Primary Examiner*—Jerry Smith
*Assistant Examiner*—Thomas E. Brown
*Attorney, Agent, or Firm*—Bell, Seltzer, Park & Gibson

[57] ABSTRACT

A method of preparing pattern information for a jacquard fabric produced on an electronically controlled knitting machine is disclosed. Yarn color information that is to be fed to yarn feeders for the courses in a knit fabric is prepared. This information is resolved into information for knitting and welting which is to be fed to different wales for each yarn feeder. Tucking information for the different colored yarns is separately prepared. This tucking information is resolved into tucking and welting pattern information. The knitting and welting information which is to be fed to different wales for each yarn feeder is combined with the separately prepared information on tucking and welting to form synthesized pattern information for knitting, welting, and tucking.

2 Claims, 3 Drawing Sheets

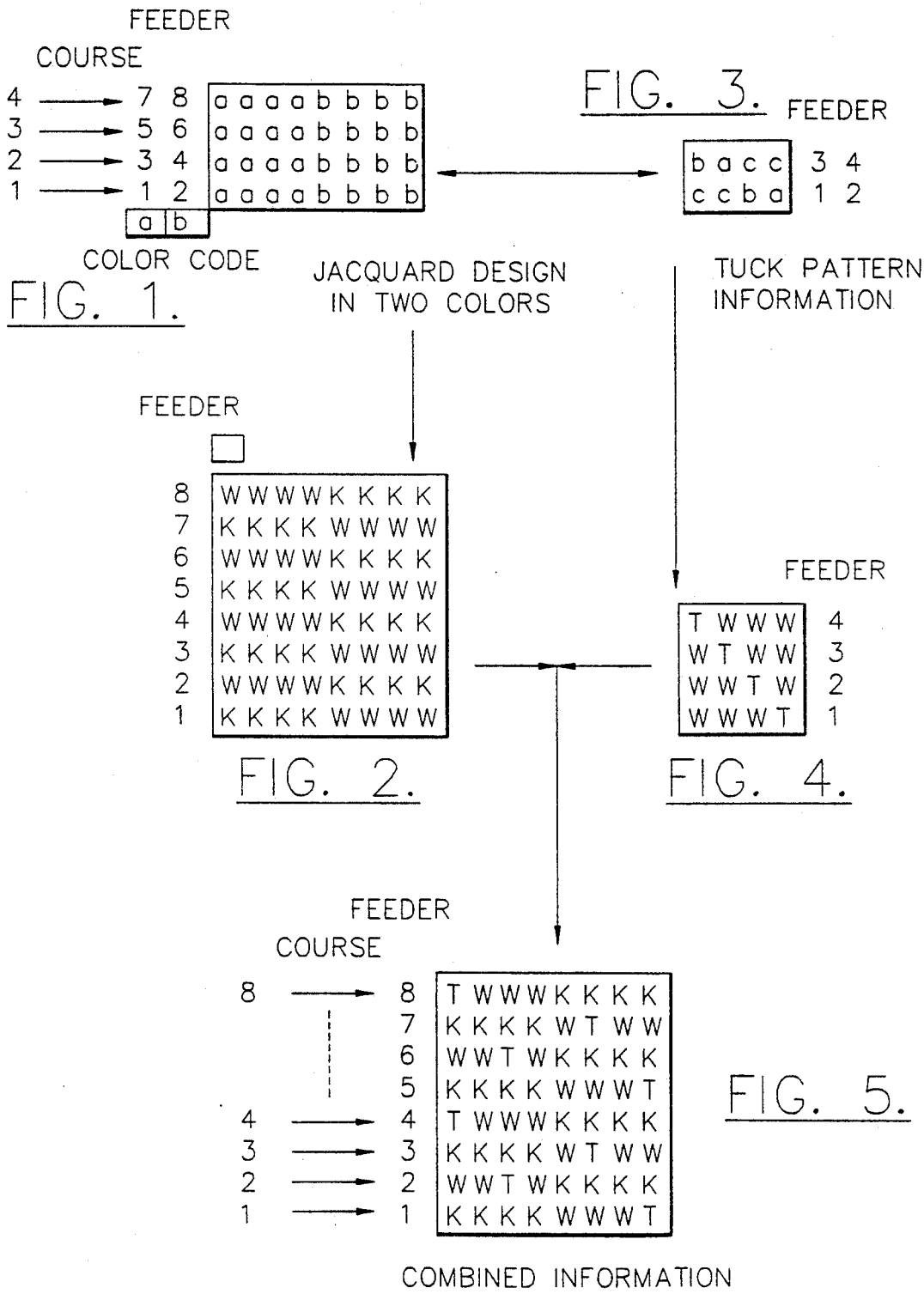
FEEDER
COURSE
4 7 8 a a a a b b b b
3 5 6 a a a a b b b b
2 3 4 a a a a b b b b
1 1 2 a a a a b b b b
a b
COLOR CODE
FIG. 1.
FIG. 3.
FEEDER
b a c c 3 4
c c b a 1 2
JACQUARD DESIGN IN TWO COLORS
TUCK PATTERN INFORMATION
FEEDER
8 W W W W K K K K
7 K K K K W W W W
6 W W W W K K K K
5 K K K K W W W W
4 W W W W K K K K
3 K K K K W W W W
2 W W W W K K K K
1 K K K K W W W W
FIG. 2.
FEEDER
T W W W 4
W T W W 3
W W T W 2
W W W T 1
FIG. 4.
FEEDER
COURSE
8 8 T W W W K K K K
7 K K K K W T W W
6 W W T W K K K K
5 K K K K W W W T
4 4 T W W W K K K K
3 3 K K K K W T W W
2 2 W W T W K K K K
1 1 K K K K W W W T
COMBINED INFORMATION
FIG. 5.

METHOD OF PREPARING PATTERN INFORMATION FOR JACQUARD FABRIC

FIELD OF THE INVENTION

This invention relates to a method of preparing pattern information for a jacquard fabric on an electronically controlled knitting machine, and more particularly, to a method of preparing information for a jacquard fabric on an electronically controlled knitting machine in which pattern information for tucking is prepared separately and then combined with information for knitting and welting.

BACKGROUND OF THE INVENTION

In a conventional electronic pattern knitting machine used in knitting jacquard fabric, usually one course of the knitted fabric is knit on the basis of pieces of color information stored within the memory of the knitting machine. Pattern information commonly is transferred from a storage medium, such as a floppy disc or paper tape, through the software loading mechanism and to the knitting machine controller, which activates/deactivates the needle selection mechanisms. The needle selection mechanisms work in conjunction with yarn feeders, which selectively feed the desired color of yarn to the knitting needles. Much of the pattern information is resolved based on individual courses of a plurality of pieces of color information.

In one common electronic pattern knitting machine, one needle selection mechanism is selectable between two positions—knitting and welting (FIG. 6). In this type of machine, tucking is not performed. When knitting a single knit fabric, the yarn floats produced by welting extend between patterns of the same color on the reverse side of the knit fabric, and the resulting structure has a reduced commercial value. The floating yarns are not fixed within the single knit fabric as would be obtained if tuck knitting were performed. In improved knitting machines, in which tucking operations are possible to form a rugged surface, all needle selection information needed to form a jacquard fabric are not always available even when the information is derived directly from the conventional knitting machine mentioned above and applied to the controller of these improved knitting machines. These more complex machines are capable of three major methods enabling needle selection at the three positions of knitting, welting, and tucking (FIGS. 7, 8 and 9). As illustrated, one yarn feeder is controlled by pairs of yarn feed mechanisms 13,14; 16,17; and 19,20, all which Can have different functions and yet enable tucking. Each needle selection mechanism typically has two states and the combination of the mechanisms provides the diversity needed for enhanced jacquard knitting.

For example, in FIG. 7, one yarn feeder has two needle selection mechanisms 13.14 associated therewith. Needle selection for knitting or Welting is performed at needle selection unit 13, and needle selection for tucking or Welting is performed at needle selection unit 14. In FIG. 9, a different method is illustrated in which needle selection at three positions is performed by needle selection mechanisms 19 and 20, which are erected vertical to each other. In FIG. 8, another method is disclosed. Thus, it is difficult to compose pattern information for these improved knitting machines on the basis of color information used on the conventional electronic pattern knitting machines.

SUMMARY OF THE INVENTION

It is therefore an object of the present invention to provide a method of preparing pattern information for jacquard knitting on electronic knitting machines enabling the desired needle selection positions for knitting, tucking and welting to form the desired color pattern for each course. In accordance with the present invention, when one course of the knitted fabric is composed on the basis of a plurality of pieces of color information in the electronic knitting machine, pattern information for knitting and welting are prepared, and pattern information for tucking is separately prepared. The two pattern informations are combined together in a microprocessor to provide synthesized pattern information for knitting, welting and tucking.

Yarn color information to be fed to yarn feeders for the courses in the knit fabric is first prepared. This information is resolved into information for knitting and welting that is to be fed to different wales for each yarn feeder. Tucking and welting information for the differently colored yarns is separately prepared. This information is resolved into tucking and welting color information. A microprocessor combines the knitting and welting information that is to be fed to different wales for each yarn feeder with the separately prepared information on tucking and welting to form synthesized pattern information for knitting, tucking and welting. In the preferred method, the information on tucking is synthesized before information on knitting in the same color is synthesized.

BRIEF DESCRIPTION OF THE DRAWINGS

Some of the objects and advantages of the present invention having been set forth above, other objects and advantages will appear as the description proceeds, when taken in conjunction with the accompanying drawings, in which:

FIG. 1 is a pattern block showing a pattern from conventional electronic pattern knitting machines having knitting and welting capability, and in which a jacquard design in two colors is assumed;

FIG. 2 is a pattern block showing pattern information derived from the pattern information of FIG. 1 in which knitting and welting are resolved together with the color information for every course;

FIG. 3 is a pattern block showing separately prepared pattern information for tucking;

FIG. 4 is a pattern block showing information prepared from the pattern information of FIG. 3 in which tucking and welting are prepared together with color information for every course;

FIG. 5 is a pattern block showing synthesized pattern information for knitting, welting, and tucking;

DETAILED DESCRIPTION OF THE PREFERRED EMBODIMENT

Figure 6:
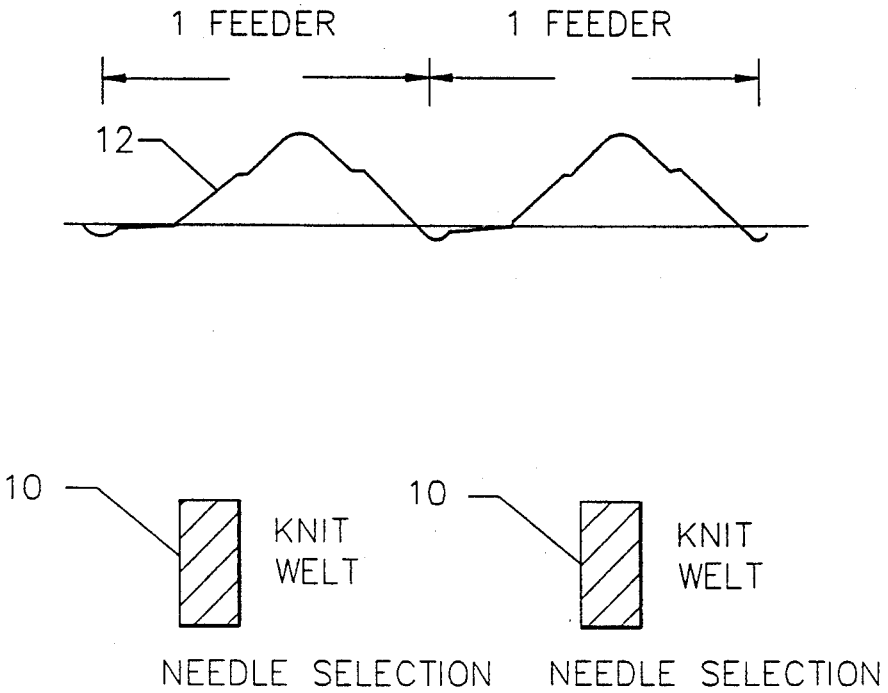
FIG. 6 is a diagram of the locus traced by the cylinder needle in a conventional electronic pattern knitting machine having knitting and welting capability.
Figure 7:
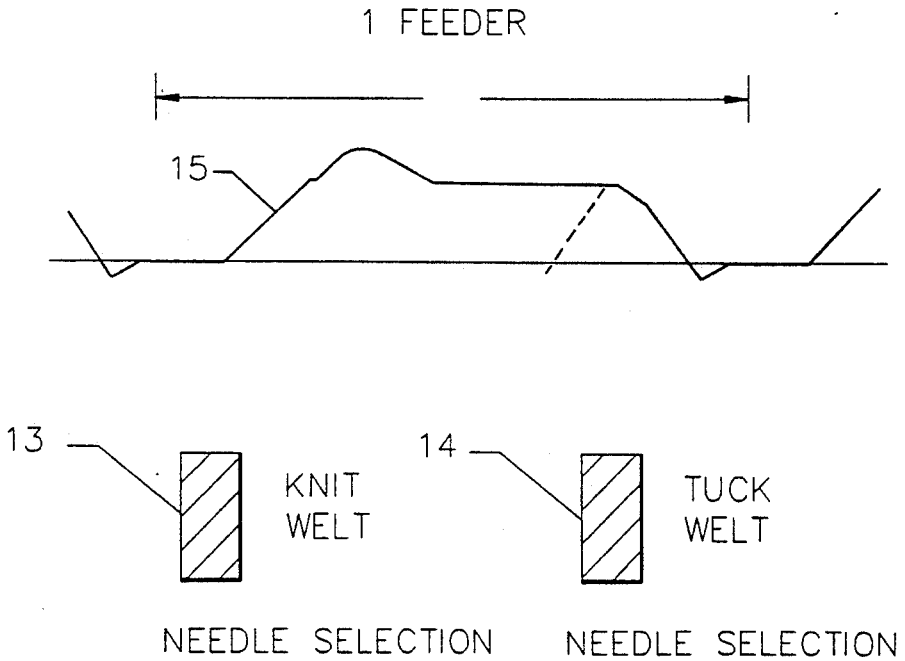
FIG. 7 is a diagram of the locus traced by the cylinder needle in an electronic knitting machine in which two needle selection mechanisms at one yarn feeder choose between knitting and welting, and tucking and welting.
Figure 8:
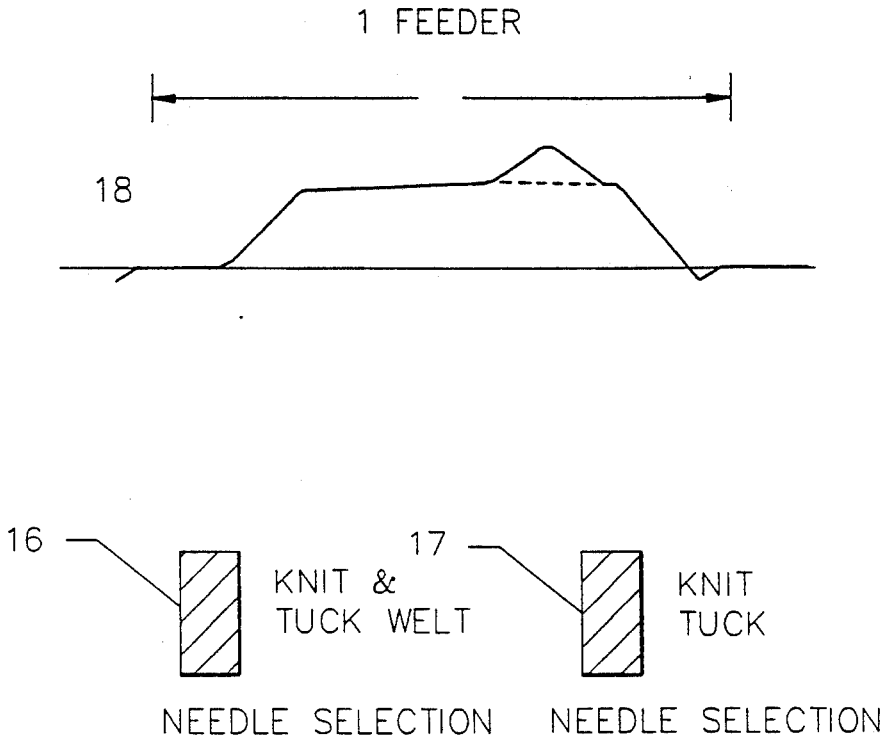
FIG. 8 is a diagram of the locus traced by the cylinder needle in an electronic knitting machine in which two needle selection mechanisms at one yarn feeder choose between selective knitting, tucking and welting at one needle selection mechanism, and choose between knitting and tucking at the other needle selection mechanisms.
Figure 9:
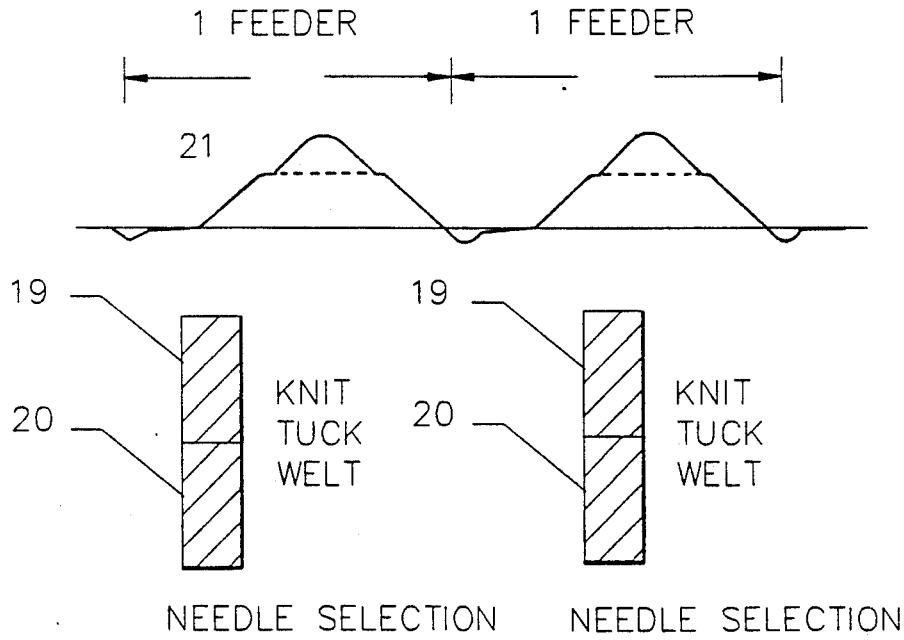
FIG. 9 is a diagram of the locus traced by the cylinder needle in an electronic knitting machine in which two sets of two needle selection mechanisms at two yarn feeders choose between selective knitting, tucking and welting.

Referring now to FIG. 1, a schematic block of pattern color information is illustrated. This pattern information is identical with that used in the conventional electronic pattern knitting machine having knitting and welting capability. The pattern illustrates a jacquard design in two colors. Reference "a" on the pattern indicates a first color, red for example. The reference "b" on the pattern indicates a second color, blue for example. In the illustrated embodiment, the red yarn is fed through 1st, 3rd, 5th, and 7th yarn feeders whereas the blue yarn is fed through the 2nd, 4th, 6th, and 8th yarn feeders. As a result, four wales in red color and four wales in blue color alternately appear in every course.

As shown in FIG. 2, the pattern information of FIG. 1 is resolved into color information for every course with the reference characters K and W indicating knitting and welting respectively. At the first yarn feeder, information for knitting K of red yarn is fed to four wales and information for welting is fed to four wales. At the second yarn feeder, information for welting W is fed to four wales and then information for knitting of blue yarn is fed to four wales. If the illustrated embodiment were knit on a single knit electronic pattern knitting machine, the red yarn would float over four wales composed of the blue yarn whereas the blue yarn would float over four wales on the reverse side of the fabric.

In accordance with the present invention, as shown in FIG. 3, information for tucking is separately prepared. The reference characters "a" and "b" represent tuck yarn components during knitting, and the "c" represents a welt yarn component.

The pattern information shown in FIG. 3 is resolved into color information in every course as shown in FIG. 4. The reference character T indicates information for tucking. For example, if this information were fed to the feeds of an electronic knitting machine, the needle selection mechanisms would select between respective knitting and tucking as required from the pattern. At the first yarn feeder, information for welting W would be fed to three wales and then that for tucking T would be fed to one wale. At the second yarn feeder, information for welting W would be fed to two wales, and information for tucking T would be fed to one wale, and the information for welting W would be fed to one wale successively.

The pattern information of FIG. 2 and FIG. 4 is synthesized and combined by a micro-processor. The microprocessor combines the information and generates a pattern as illustrated in FIG. 5, which shows the synthesized pattern information for knitting, tucking and welting. The pattern information shows that information on tucking of the wales is synthesized and combined before information on knitting in the same color is synthesized and combined. Thus, in the pattern of FIG. 4, the knitting K pattern for each course remains for each color.

In the illustrated example, four wales are knitted with the red yarn and then four wales with the blue yarn. One tuck stitch of the blue yarn is formed during knitting of a course. One tuck stitch is formed with red yarn during knitting with the blue yarn. With this tucking step, floating of the yarn that occurs during continuous needle selection for welting in the single knit fabric is accomplished and a diversified knit structure having a rugged surface can be obtained. Fixation of the floating yarn in a single knit fabric is now possible with the pattern as originally provided on a conventional electronic pattern knitting machine. The combined information can be transmitted directly to electronic pattern knitting machine or stored on a floppy disk or paper tape.

In the drawings and specification there has been set forth the best mode presently contemplated for the practice of the present invention, and although specific terms are employed, they are used in generic and descriptive sense only, and not for purposes of limitation, the scope on the invention being defined in the following claims.

That which is claimed is:

1. A method of preparing pattern information for a jacquard fabric produced on an electronically controlled knitting machine comprising the steps of preparing yarn color information to be fed to yarn feeders for determining the particular yarns to be knit in different wales of each course in a knit fabric, resolving the prepared yarn color information into information to be fed to needle operation mechanisms for determining the knitting and welting positions of the needles as they pass each yarn feeder, separately preparing information for determining the tucking and welting positions of the needles as they pass each yarn feeder for the differently colored yarns, and combining the knitting and welting needle position information for each yarn feeder with the separately prepared tucking and welting needle position information to form synthesized pattern information for knitting, tucking and welting.

2. The method according to claim 1 wherein the step of combining the information on tucking and welting with the information of welting and knitting includes the step of combining and synthesizing information on the tucking needle position for the wales before information for knitting in the same color is synthesized and combined.

* * * * *